US010045670B1

(12) United States Patent
Matos

(10) Patent No.: US 10,045,670 B1
(45) Date of Patent: Aug. 14, 2018

(54) CHILD TRAINING TOILET

(71) Applicant: Cherise Matos, Goose Creek, SC (US)

(72) Inventor: Cherise Matos, Goose Creek, SC (US)

( * ) Notice: Subject to any disclaimer, the term of this patent is extended or adjusted under 35 U.S.C. 154(b) by 0 days.

(21) Appl. No.: 15/630,193

(22) Filed: Jun. 22, 2017

(51) Int. Cl.
*A47K 11/04* (2006.01)
*A47K 11/06* (2006.01)
*A47K 13/02* (2006.01)
*A47K 13/24* (2006.01)

(52) U.S. Cl.
CPC ..... *A47K 11/06* (2013.01); *A47K 13/02* (2013.01); *A47K 13/24* (2013.01)

(58) Field of Classification Search
CPC ..... A47K 11/06; A47K 13/62; A47K 13/24
USPC ..... 4/483
See application file for complete search history.

(56) References Cited

U.S. PATENT DOCUMENTS 2,895,142 A * 7/1959 Nagel ..... A47K 11/04 4/478
2005/0044627 A1* 3/2005 Birmingham ..... A47K 13/24 4/661
2011/0030134 A1* 2/2011 Dubiel ..... A47K 11/06 4/483

* cited by examiner

*Primary Examiner* — Huyen Le
(74) *Attorney, Agent, or Firm* — Gulf Coast Intellectual Property Group

(57) ABSTRACT

A child training potty configured to inhibit access to a waste receptacle thereof so as to prevent contact with human waste present therein. The child training potty includes a base being formed from a plurality of walls and a bottom creating an interior volume. A waste receptacle is disposed within the interior volume of the base and is releasably secured therein. A seat member is superposed the base and is movably mounted thereto wherein the seat member is configured to traverse in an upwards-downwards direction. A plurality of springs are intermediate the seat member and the base. An access door is hingedly secured proximate the opening of the waste receptacle. The seat member further has engagement rods extending downward therefrom that are operable to move the access door from a first position to a second position. The access door includes a first portion and a second portion.

20 Claims, 2 Drawing Sheets

CHILD TRAINING TOILET

FIELD OF THE INVENTION

The present invention relates generally to child healthcare products, more specifically but not by way of limitation, a child training toilet that is operable to assist a child during the training process for transitioning from diapers to use of a toilet wherein the present invention inhibits access to human waste ensuing deposit into the child training toilet.

BACKGROUND

During child rearing years parents will undergo various training processes with the child as they transition through various stages of growth. As children begin to move from the infant stage of their lifecycle to the child stage parents will begin to teach the children to execute tasks on their own. By way of example but not limitation, children will begin to learn to utilize eating utensils and to dress themselves. Another task that all children must learn is to begin to utilize a toilet as they transition from utilizing diapers. Ages vary depending upon the child but most children begin this process around two and a half years of age. As children begin to transition to utilize the toilet parents will utilize articles such as but not limited to training pants. Another apparatus commonly utilized is a small child toilet. As is known in the art, child training toilets are small toilet replicas that do not contain plumbing and are superposed the floor. The size of these toilets allows a small child to utilize when they need to go to the bathroom. Subsequent use of the child training toilet the waste is deposited into a toilet for disposal.

One problem with existing child toilets is unrestricted access to the waste receptacle. Conventional child toilets are configured with a waste receptacle that is immediately underneath the seat so as to receive the waste during use by a child. Ensuing use, a child has access to the waste receptacle and can visually see and physically access the waste receptacle. This presents a health safety issue as some children who may be temporarily unattended will see the waste and then physically engage therewith by touching. This is undesirable as engaging the waste can create hygiene issues as well as require additional cleaning of the child.

Accordingly, there is a need for a child training toilet that is configured to be utilized by a small child wherein the child training toilet is constructed to inhibit access to the waste ensuing deposit thereof into the child training toilet.

SUMMARY OF THE INVENTION

It is the object of the present invention to provide a child training toilet configured to be superposed the floor and accessible by a small child that includes a base.

Another object of the present invention is to provide a child training toilet that is configured to be utilized by a child during transition from diapers to a full size toilet wherein the base further includes a waste receptacle having a centrally located opening.

A further object of the present invention is to provide a child training toilet that is constructed to be accessible by a small child that further includes a seat mounted above the waste receptacle wherein the seat is movably mounted so as to move in an up-down direction.

Still another object of the present invention is to provide a child training toilet that is operable to assist in the toilet training of a young child that further includes an hingedly mounted access door that is operable to cover the centrally located opening.

An additional object of the present invention is to provide a child training toilet configured to utilized by a small child during the toilet training process wherein the seat further includes engagement rods that are configured to transition the access door intermediate an open and closed position.

Yet a further object of the present invention is to provide a child training toilet constructed to inhibit access to waste deposited therein wherein the child training toilet is manufactured from a durable lightweight material such as but not limited to plastic.

Another object of the present invention is to provide a child training toilet configured to inhibit access to waste deposited therein that further includes a lid hingedly secured so as to cover the seat.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
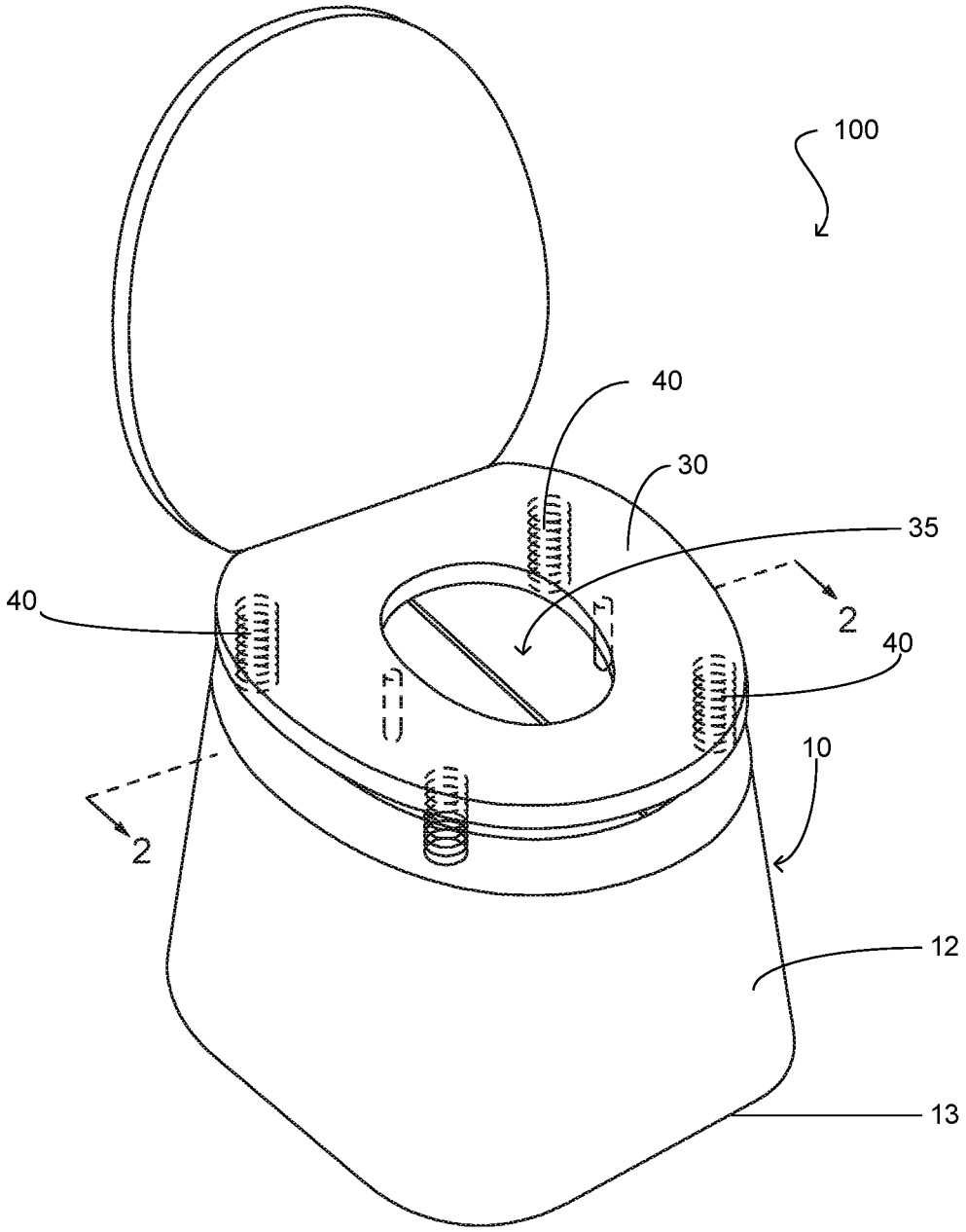
FIG. 1 is a perspective view of an embodiment of the present invention.

Referring now to the drawings submitted herewith, wherein various elements depicted therein are not necessarily drawn to scale and wherein through the views and figures like elements are referenced with identical reference numerals, there is illustrated a child training toilet 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
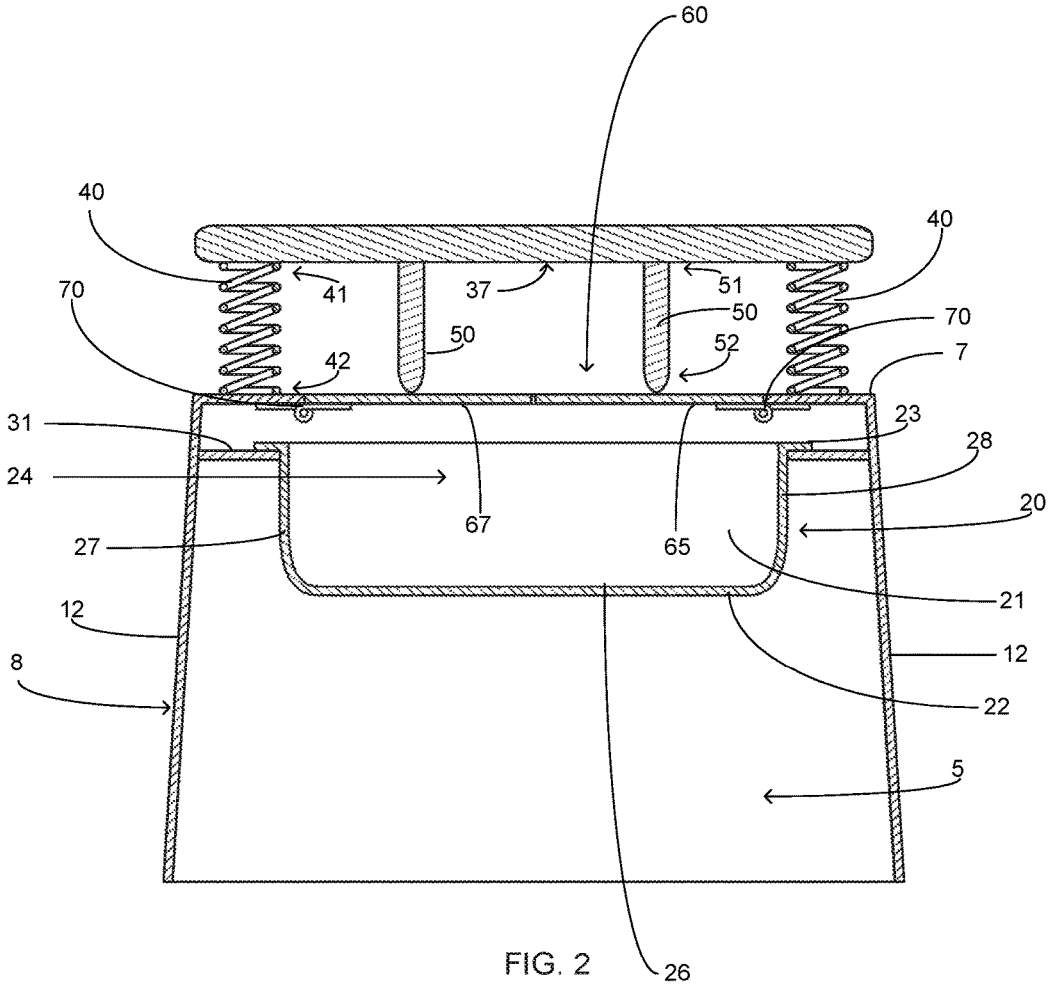
FIG. 2 is a cross-sectional view of the embodiment of the present invention.

Referring in particular to FIG. 1 and FIG. 2 herein, the child training toilet 100 further includes a base 10. The base 10 is formed from a plurality of walls 12 and bottom 13 that are integrally formed utilizing suitable durable methods. While the base 10 is illustrated herein in a particular shape, it is contemplated within the scope of the present invention that the base 10 could be formed in alternate shapes utilizing alternate quantities of walls 12. It should be further understood that the base 10 is manufactured having a height that is configured so as to allow a small child take a seating position on seat member 30. The base 10 includes waste receptacle 20. Waste receptacle 20 is releasably secured within the interior volume 5 of the base 10. The waste receptacle 20 is formed from a contiguous wall 22 wherein the wall 22 includes a bottom portion 26 and side portion 27,28 that extend upward from the bottom portion 26. An upper lip 23 is circumferentially disposed on wall 22 and is configured to engage ledge 31 so as to suspendedly secure the waste receptacle 20 within base 10. The waste receptacle 20 includes interior volume 21 having an opening 24 providing access thereto wherein the interior volume 21 is of suitable size to accommodate human waste therein. The waste receptacle is sized so as to substantially extend across the width and depth of the base 10 ensuring alignment with aperture 35 of seat member 30.

Seat member 30 is generally oval in shape having aperture 35 configured to provide access to waste receptacle 20. The seat member 30 is movably secured to the base 10. Springs 40 are mounted utilizing suitable durable techniques to the bottom surface 37 of seat member 30. Springs 40 include first end 41 and second end 42 wherein the second end 42 are secured to upper support member 7 of base 10. The springs 40 facilitate an upwards-downwards movement of the seat member 30. Upon a child assuming a seated position on seat member 30, the springs 40 will be compressed under the weight of the child and as such traverse the seat member 30 in a downward direction. While springs 40 are illustrated herein as being present to facilitate the upwards-downwards movement of the seat member 30, it is contemplated within the scope of the present invention that alternate movement means could be utilized in place of and/or in conjunction with the springs 40. It is further contemplated within the scope of the present invention that the seat member 40 could utilize any quantity of springs 40 to accomplish the desired functionality described herein.

Further secured to the bottom surface 37 of the seat member 30 are engagement rods 50. Engagement rods 50 are manufactured from a rigid material and are positioned so as to extend downward from the seat member 30. The engagement rods 50 include a first end 51 and second end 52 wherein second end 52 is operable to engage access door 60. The second end 52 of the engagement rod 50 is rounded in shape so as to improve the slidable engagement with the access door 60 as will be further discussed herein.

An access door 60 is hingedly secured to the upper support member 7 utilizing hinges 70. Access door 60 includes a first portion 65 and a second portion 67 that are operable to move intermediate a first position and a second position. In FIG. 2, the access door 60 is illustrated in its first position wherein the first portion 65 and the second portion 67 are parallel and position to cover the opening 24 so as to inhibit access to interior volume 21 of the waste receptacle 24. First portion 65 and second portion 67 are transitioned to their second position (not illustrated herein) wherein as a result of the weight of a child being present on seat member 30 the seat member 30 traverses in a downward direction. As the seat member 30 traverses in a downward direction, engagement rods 50 apply force to the first portion 65 and second portion 67 of the access door 60 causing the first portion 65 and second portion 67 to hingedly move outwards towards side portion 28, 27. Ensuing movement towards its second position the opening 24 is unrestricted so as to allow a child to deposit waste into the interior volume 21 of the waste receptacle 20. Subsequent completion of waste deposit by a child, as a child removes themselves from the seat member 30, the seat member 30 traverses in an upward direction being moved by springs 40. As seat member 30 moves in an upward direction, the engagement rods 50 move in the same direction resulting in the access door 60 being returned to its first position wherein the first portion 65 and second portion 67 are parallel and as such restrict access to the interior volume 21 of the waste receptacle 20.

While the access door 60 is illustrated herein as having a first portion 65 and a second portion 67 configured to be moved by engagement rods 50, it is contemplated within the scope of the present invention that the child training toilet 100 could deploy alternate elements configured to accomplish the desired objective of moving the access door 60 intermediate a first position and a second position. It is further contemplated within the scope of the present invention that the access door 60 could be configured in alternate manners such as but not limited to being retractable in order to accomplish the desired functionality described herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A child training toilet configured to inhibit access to human waste present therein comprising:

a base, said base having at least one wall and a bottom, said at least one wall and said bottom being integrally formed creating an interior volume;

a waste receptacle, said waste receptacle having an opening and an interior volume configured to receive human waste therein, said waste receptacle being releasably secured within the interior volume of said base;

a seat member, said seat member being superposed said base, said seat member being oval in shape having a centrally located aperture, said seat member being movably mounted to said base;

a moving means, said moving means being intermediate said seat member and said base, said moving means configured to facilitate movement of the seat member;

an access door, said access door being proximate said opening of said waste receptacle, said access door having a first position and a second position; and wherein in said second position said access door being positioned so as to allow human waste to be deposited into the interior volume of the waste receptacle.

2. The child training toilet as recited in claim 1, and further including engagement rods, said engagement rods having a first end and a second end, said engagement rods extending downward from said seat member, said engagement rods operably coupling said seat member and said access door.

3. The child training toilet as recited in claim 2, wherein said seat member is operable to move in an upwards-downwards direction.

4. The child training toilet as recited in claim 3, wherein said access door further includes a first portion and a second portion, said first portion and said second first portion being hingedly secured to said base.

5. The child training toilet as recited in claim 4, wherein said waste receptacle includes a lip member, said lip member being circumferentially disposed on said waste receptacle.

6. The child training toilet as recited in claim 5, wherein in said first position said access door being configured to inhibit access to said interior volume of said waste receptacle.

7. The child training toilet as recited in claim 6, wherein said moving means are a plurality of springs.

8. A child training toilet configured to inhibit access to human waste present therein comprising:

a base, said base having a plurality of walls and a bottom, said plurality of walls and said bottom being integrally formed creating an interior volume;

a waste receptacle, said waste receptacle having a wall forming an interior volume, said waste receptacle further having an opening providing access to said interior volume, said waste receptacle being releasably secured within the interior volume of said base;

a seat member, said seat member being superposed said base, said seat member being oval in shape having a centrally located aperture, said seat member being movably mounted to said base;

a moving means, said moving means being intermediate said seat member and said base, said moving means configured to facilitate movement of the seat member;

an access door, said access door being proximate said opening of said waste receptacle, said access door having a first portion and a second portion, said first portion and said second portion of said access door being hingedly secured to said base, said access door having a first position and a second position;

an engagement means, said engagement means operably coupling said seat member and said access door, said engagement means configured to traverse said access door intermediate said first position and said second position; and wherein in said second position said access door being positioned so as to allow human waste to be deposited into the interior volume of the waste receptacle.

9. The child training toilet as recited in claim 8, wherein said engagement means are rods, said rods having a first end and a second end, said first end of said engagement means being secured to said seat member, said second end of said rods configured to engage said access door.

10. The child training toilet as recited in claim 9, wherein said waste receptacle further includes a lip member, said lip member being circumferentially disposed on said waste receptacle, said lip member operable to suspendedly mount said waste receptacle within the interior volume of said base.

11. The child training toilet as recited in claim 10, wherein said seat member is configured to move in an upwards-downwards movement, wherein the downward movement of said seat member is facilitated by a child assuming a seating position on said seat member.

12. The child training toilet as recited in claim 11, wherein said access door is transitioned to said second position as said seat member is traversed in a downward direction.

13. The child training toilet as recited in claim 12, wherein said base further includes an upper support member, said upper support member disposed within the interior volume of said base, said upper support member configured to engage said lip member.

14. The child training toilet as recited in claim 13, wherein said moving means are a plurality of springs.

15. A child training toilet configured to inhibit access to human waste present therein comprising:

a base, said base having a plurality of walls and a bottom, said plurality of walls and said bottom being integrally formed creating an interior volume;

a waste receptacle, said waste receptacle having a wall forming an interior volume, said waste receptacle further having an opening providing access to said interior volume, said waste receptacle being releasably secured within the interior volume of said base;

a seat member, said seat member being superposed said base, said seat member being oval in shape having a centrally located aperture, said seat member being movably mounted to said base, said seat member having a bottom surface;

a plurality of springs, said plurality of springs being mounted to said bottom surface of said seat member, said plurality of springs having a first end and a second end, said plurality of springs configured to movably couple said seat member to said base;

an access door, said access door being proximate said opening of said waste receptacle, said access door having a first portion and a second portion, said first portion and said second portion of said access door being hingedly secured to said base, said access door having a first position and a second position;

engagement rods, said engagement rods being mounted to said bottom surface of said seat member extending downward therefrom, said engagement rods having a first end and a second end wherein said second end of said engagement rods are configured to operably couple with said first portion and said second portion of said access door; and wherein in said second position said access door is positioned so as to allow human waste to be deposited into the interior volume of the waste receptacle.

16. The child training toilet as recited in claim 15, wherein said waste receptacle further includes a lip member, said lip member being circumferentially disposed on said waste receptacle, said lip member operable to suspendedly mount said waste receptacle within the interior volume of said base.

17. The child training toilet as recited in claim 16, wherein said base further includes an upper support member, said upper support member disposed within the interior volume of said base, said upper support member configured to engage said lip member.

18. The child training toilet as recited in claim 17, wherein in said first position said first portion and said second portion of said access door are parallel across the opening of said waste receptacle so as to inhibit access to said interior volume of said waste receptacle.

19. The child training toilet as recited in claim 18, wherein said access door is transitioned to said second position as said seat member is traversed in a downward direction.

20. The child training toilet as recited in claim 19, wherein said second end of said engagement rods are rounded in shape.

* * * * *